US007426155B2

(12) United States Patent
Fluegge

(10) Patent No.: US 7,426,155 B2
(45) Date of Patent: Sep. 16, 2008

(54) STRETCHING AND EXERCISING APPARATUS

(76) Inventor: Michael Fluegge, 400 Mills Ave., #219, Greenville, SC (US) 29605

( * ) Notice: Subject to any disclaimer, the term of this patent is extended or adjusted under 35 U.S.C. 154(b) by 165 days.

(21) Appl. No.: 11/233,740

(22) Filed: Sep. 23, 2005

(65) Prior Publication Data

US 2007/0070817 A1 Mar. 29, 2007

(51) Int. Cl.
*G04B 47/00* (2006.01)

(52) U.S. Cl. ..... 368/10; 482/907; 482/131

(58) Field of Classification Search ..... 368/10; 482/83–84

See application file for complete search history.

(56) References Cited

U.S. PATENT DOCUMENTS

| | | | | |
|---|---|---|---|---|
| 61,702 | A | 2/1867 | Barnett | |
| 835,035 | A | 11/1906 | Rigbey | |
| 4,262,898 | A * | 4/1981 | Lee | 482/49 |
| 4,593,902 | A * | 6/1986 | Michaelsen | 482/140 |
| 4,736,946 | A | 4/1988 | Gordon | |
| 4,943,047 | A * | 7/1990 | Noble | 482/49 |
| 5,042,799 | A | 8/1991 | Stanley | |
| 5,230,679 | A | 7/1993 | Olsen | |
| 5,538,486 | A | 7/1996 | France et al. | |
| 5,558,609 | A | 9/1996 | Olschansky et al. | |
| 5,746,687 | A | 5/1998 | Vial et al. | |
| 6,001,048 | A * | 12/1999 | Taylor | 482/81 |
| 6,361,516 | B1 | 3/2002 | Hamel | |
| 6,409,636 | B1 * | 6/2002 | Risso et al. | 482/82 |
| 6,540,649 | B1 * | 4/2003 | Niedrich | 482/82 |
| 2003/0134725 | A1 | 7/2003 | Kim | |
| 2004/0190383 | A1 * | 9/2004 | Marcucelli et al. | 368/278 |
| 2005/0180264 | A1 * | 8/2005 | Farinella et al. | 368/10 |
| 2005/0288158 | A1 * | 12/2005 | LaTour | 482/81 |

OTHER PUBLICATIONS

Healthy Jump: Tanita. 2001.*

* cited by examiner

*Primary Examiner*—Vit W. Miska
*Assistant Examiner*—Sean Kayes
(74) *Attorney, Agent, or Firm*—McNair Law Firm; Cort Flint

(57) ABSTRACT

The invention is a stretching apparatus comprised of first and second elongate handles having first and second ends for being held by an individual during use and a strap carried by both the first and second handles such that at least a portion of the strap is exposed for engaging the foot of an individual during use. A timer carried by the second end of at least one of the first and second handles determines the time elapsed during use. A timer actuator disposed between the strap and the timer actuates the timer upon a movement of the strap. An audible indicator, carried by at least one of the first and second handles in communication with the timer, audibly indicates the elapsing of a predetermined period of time. The apparatus further consists of a visual indicator for visually indicating the elapsing of a predetermined amount of time.

22 Claims, 4 Drawing Sheets

STRETCHING AND EXERCISING APPARATUS

FIELD OF THE INVENTION

This invention is directed to a stretching and exercising apparatus. More specifically, the invention is directed to a stretching apparatus having elongated handles housing a strap that is used in stretching and having an integrated timing device for timing the stretch. More specifically, this invention is directed to a leg stretching apparatus for the hamstring muscles.

BACKGROUND OF THE INVENTION

It is well known that stretching can have positive effects on the health of individuals. It is advised by most physicians and personal trainers that individuals should stretch prior to and subsequent to any form of exercise. These recommendations for stretching also include that stretching should be done for a long enough time in a fully stretched position. Bouncing into a predetermined position, and not maintaining a static hold of that position, does not give the individual the benefits of a proper stretch. It is advantageous for an individual to stretch and hold a static position for a predetermined period of time, such as 30 seconds or 1 minute, in order to obtain all the advantageous effects of stretching.

Significant medical data shows that inflexible hamstring muscles can be a major cause for chronic lower back pain conditions. Serious problems may occur for those people whose jobs require them to sit for extended periods of time. For example, an individual that works in a seated position for a prolonged period of time keeps their hamstrings in a constricted position. Stretching the hamstring muscles regularly for 30 to 60 seconds can alleviate back pain by lessening a downward rotation of the hamstring muscles exerted on the hip. Any downward rotation of a hip can cause a reversal of normal lumbar spine curvature, and therefore, causes pain by impinging lumbar spinal nerves. As such, it is especially advantageous for someone that works in a seated environment to perform stretches related to their hamstring.

U.S. Pat. No. 5,538,486 discloses a sophisticated instrumented therapy cord device, including a load cell transducer, a resistive stretch cord, and a microprocessor. A handle attached to the resistive strap may be grasped for therapeutic exercise.

U.S. Pat. No. 5,230,679 discloses a leg exercise device comprised of non-stretchable tubing reinforced by an inner core tubing having handgrips at both ends. An intermediate portion of the core tubing is engaged by a foot.

U.S. Pat. No. 5,004,228 discloses a leg stretching apparatus comprising a strap and adjustable handgrips.

Accordingly, an object of the present invention is to provide a stretching and exercising apparatus for effectively conditioning the hamstring muscles for a controlled duration, particularly for those required to be seated for long periods of time.

SUMMARY OF THE INVENTION

The above objections are accomplished according to the present invention by providing a stretching apparatus comprised of first and second elongate handles for being grasped by an individual during use. The handles include first and second ends and a carry strap along their length. A timer unit is carried by the first handle for determining the time elapsed during use. A timer actuator, comprised of a pull-pin, is connected to the strap and actuates the timer upon a movement of the strap. Further, a foot grip, engaged by an individual's foot during use, is defined by an exposed portion of the strap extending between the second ends of the handles. In a further embodiment, the first and the second elongate handles include a strap adjusting means carried by at least one of the handles for adjusting the length of the strap. The strap is connected to the timer actuator by a strap connector, comprised of a D-ring.

An audible indicator, which may comprise a speaker or buzzer, is carried in communication with the timer for audibly indicating the elapsing of a predetermined period of time. In a further embodiment, the apparatus further consists of a visual indicator, which may be a light emitting diode, for visually indicating the elapsing of a predetermined amount of time. A power supply is operatively associated with the timer and the indicator.

An actuator pad carried by the timer actuator prevents the operation of the timer while in contact with the timer. The timer includes a switch pad, and has a de-actuated position when the actuator pad contacts the switch pad and an actuated position when the contact between the actuator pad and switch pad is broken due to movement by the strap. The actuator pad includes a conductive pad, comprised of carbon that opens the timer circuit in the de-actuated position. The timer circuit produces a plurality of audible signals at predetermined intervals. A final audible signal distinguishable from the plurality of audible signals is produced by the timer circuit at a predetermined time following the plurality of audible signals.

In another aspect, the invention includes a method of assisting an individual while stretching using an associated stretching apparatus which comprises a stretching apparatus having two elongate handles, a strap, a timer actuator, a timer and an indicator. The strap is moved a predetermined distance indicating a proper stretch position has been achieved. A timer actuator is engaged in response to moving the strap such that the timer actuator is spaced from the timer. The elapsing of a predetermined period of time is then indicated on the indicator.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
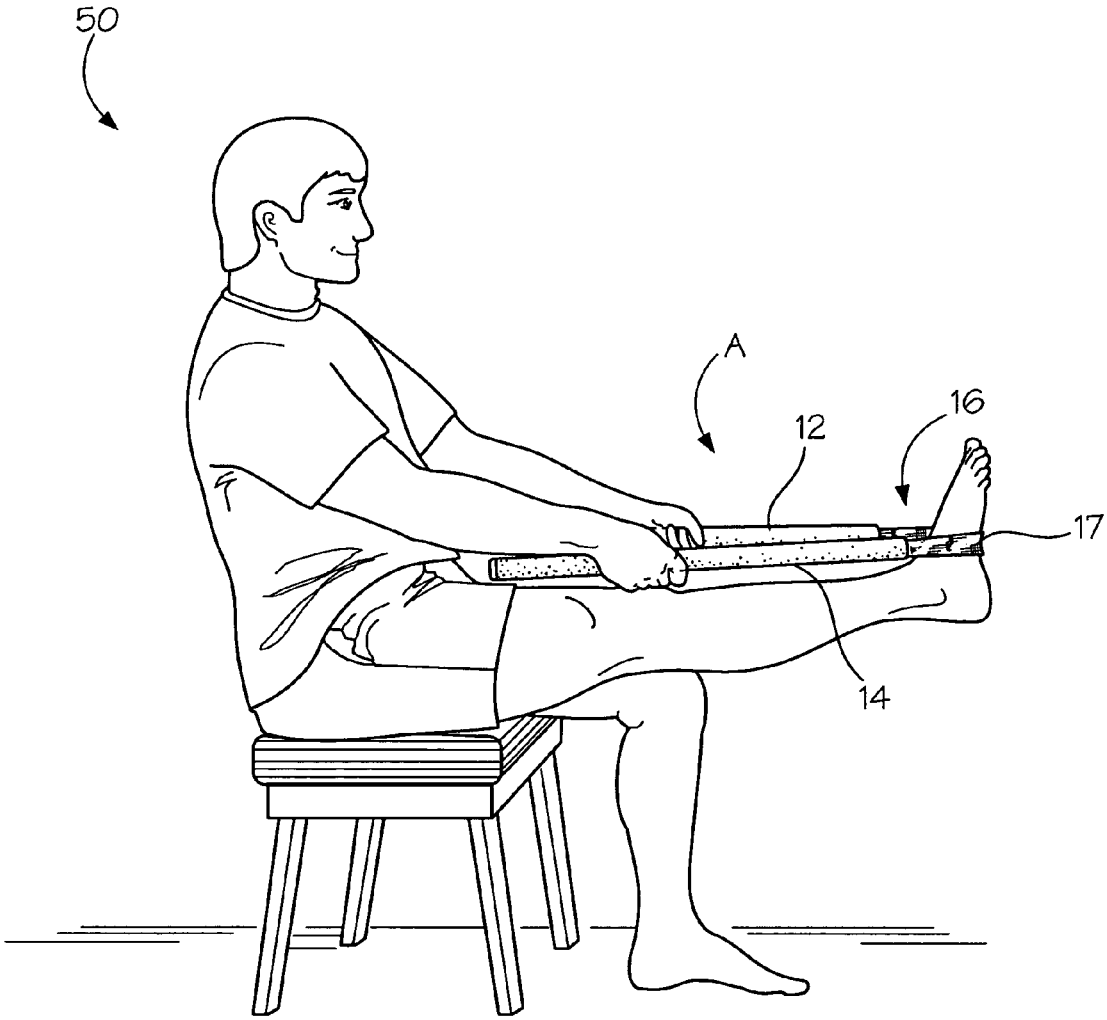
FIG. 1 is a perspective view illustrating the stretching and exercising apparatus in use while the user is in a seated position.

Referring now to the drawings, the invention will now be described in more detail.

Figure 2A:
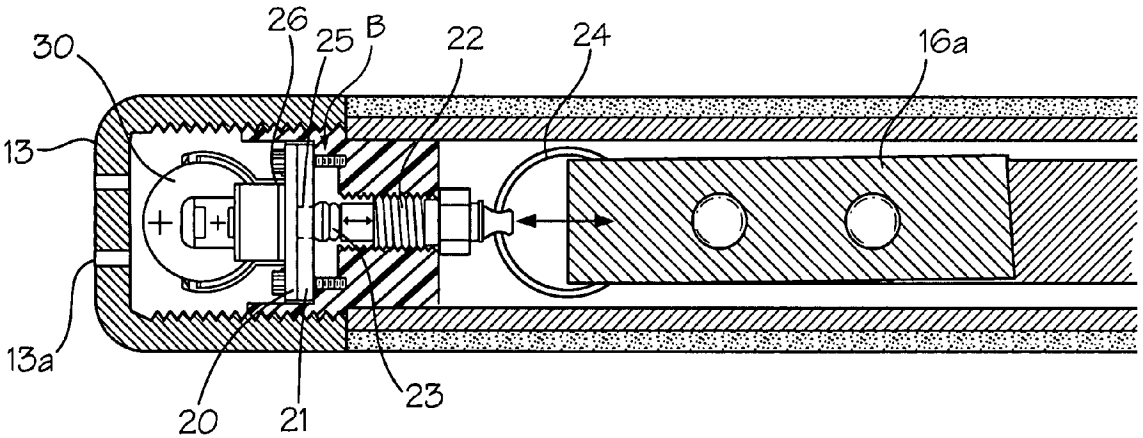
FIG. 2A is a cutaway side elevation of a handle portion of the invention illustrating a strap according to the invention connected to a timer actuator, which is connected in turn to a timer, which is connected in turn to an audible indicator.
Figure 2B:
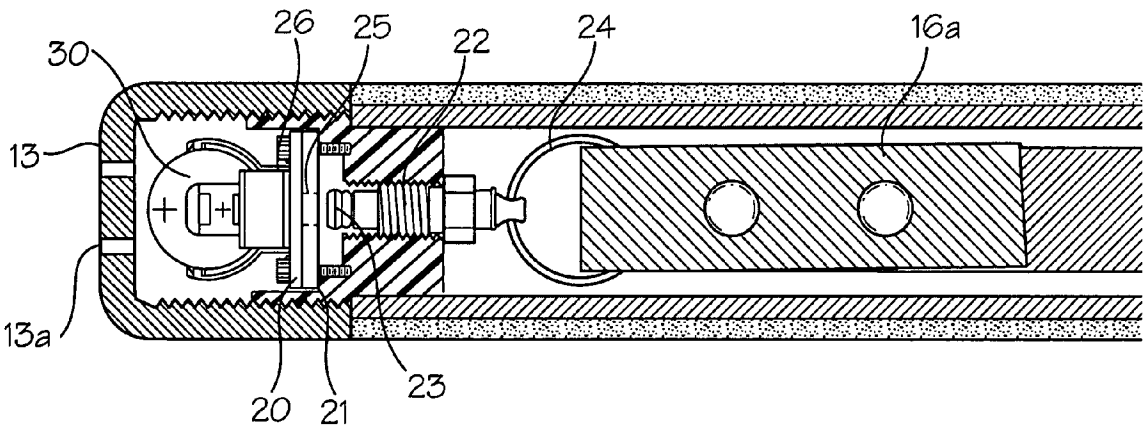
FIG. 2B is a cutaway side elevation as in FIG. 2A illustrating the timer actuator in a moved position allowing the timer to operate according to the invention.
Figure 2C:
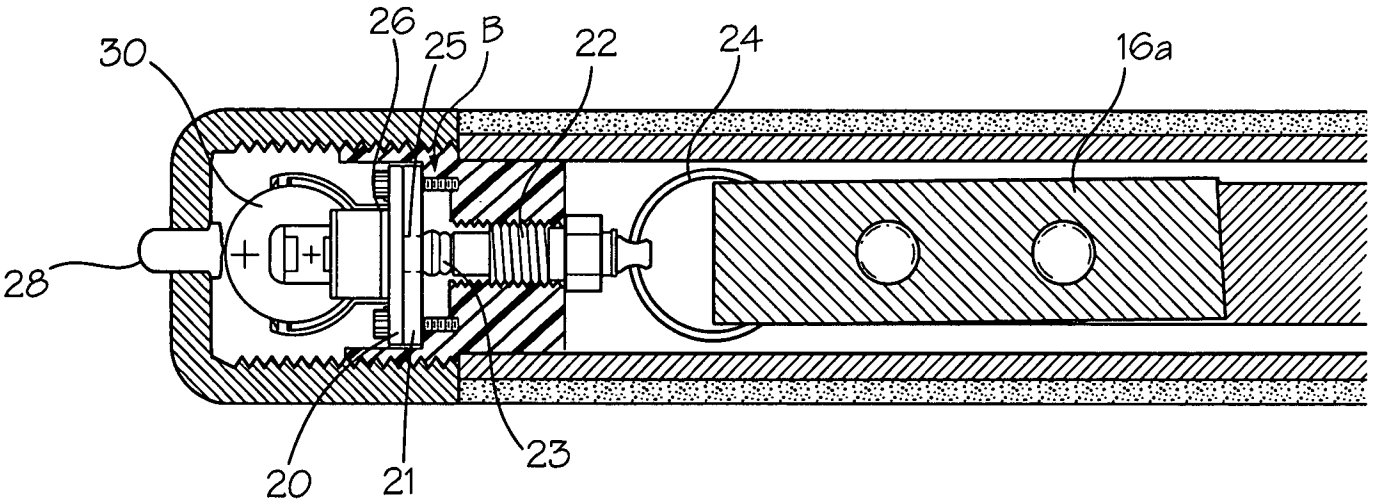
FIG. 2C is a cutaway side elevation illustrating a further embodiment of the invention, further including a visual indicator.
Figure 2D:
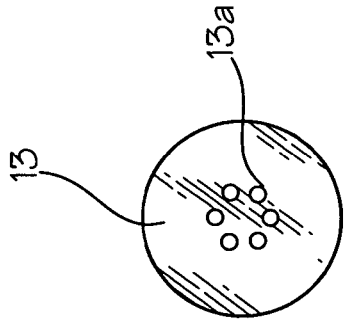
FIG. 2D is a top plan view illustrating an end cap of a handle according to the invention.
Figure 3A:
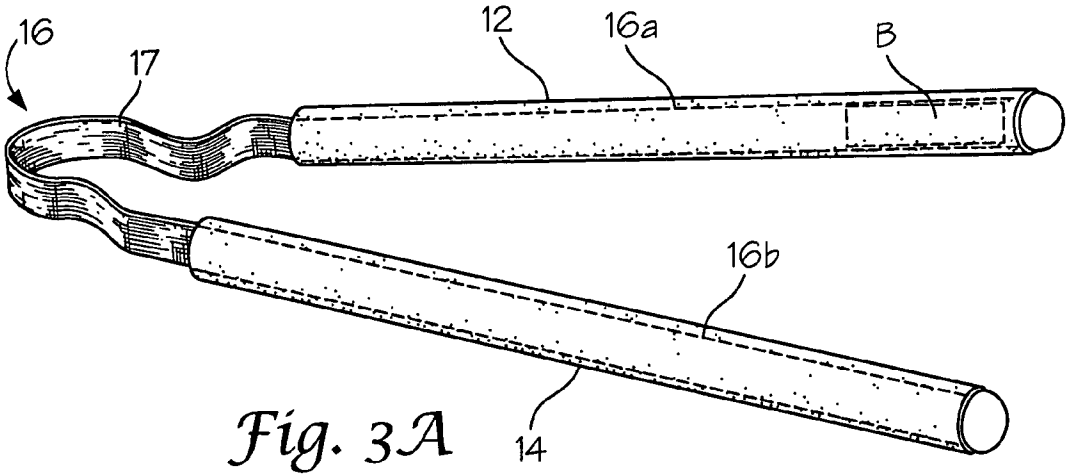
FIG. 3A is a perspective view illustrating a strap and elongated handles of a stretching apparatus according to the invention.

As can best be seen in FIG. 3A, a stretching apparatus, designated generally as A, is illustrated including a first elongate handle 12 for being held by an individual during use. First elongated handle 12 contains first end 12*a* and second end 12*b*. Likewise, a second elongated handle 14 contains first end 14*a* and second end 14*b*. FIG. 2C illustrates an end view of second end 12*b* of first elongated handle 12 having an end cap 13 containing a plurality of holes 13*a* for allowing the emission of sound from the audible indicator. Strap 16 is carried by said first and second elongate handles. It is carried in a manner that exposes a portion of the strap to provide a foot grip 17.

Stretching apparatus A contains a timer unit B having a timer 20 which may be disposed in either of the elongate handles, or alternatively two timers may be included in the apparatus, one in each handle. In a preferred embodiment, timer 20 is carried by second end 12*b* of first elongate handle 12. The timer determines how much time is lapsed during the use of the stretching apparatus. Timer 20 includes a printed circuit board 21 that operates the timer. A switch pad 25 is carried adjacent to the printed circuit board of the timer. The switch pad is adapted to receive a timer actuator 22 as described below. Timer 20 is actuated by timer actuator 22. Timer actuator 22 is connected to an end 16*a* of strap 16. In a preferred embodiment, D-ring 24 connects strap 16 to timer actuator 22. Timer actuator 22 is connected to conductive pad 23. The conductive pad is made of carbon in a preferred embodiment. While in the de-actuated position, conductive pad 23 makes contact with switch pad 25 of the printed circuit board portion of the timer. As conductive pad 23 does not allow the flow of electricity in the timer, timer 20 cannot operate while timer actuator 22 is in this position. Upon the occurrence of a predetermined movement of the strap, timer actuator 22 actuates timer 20.

Pull-pin 22 is threaded into a housing in the end cap of one of the elongate handles. Timer actuator 22 moves perpendicular relative the timer such that conductive pad 23 may contact the switch pad of the printed circuit board of the timer in a de-actuated position, and be spaced away from the switch pad of the printed circuit board of timer 20 in an actuated position. Timer actuator 22 is a pull-pin, and thus, when strap 16 is pulled to a predetermined position, timer actuator 22 moves conductive pad 23 such that it is spaced from switch pad 25 of timer 20, allowing timer 20 to operate. An indicator 26 is included with timer unit B. The indicator, as the timer above, may be disposed within either or both of the elongated handles. In a preferred embodiment as disposed in second end 12*b* of handle 12. In a preferred embodiment shown in FIG. 2A, indicator 26 is an audible indicator. Audible indicator 26 may be a speaker, a buzzer, or any other member capable of emitting an audible alert indicating the elapsing of a predetermined period of time. FIG. 2B illustrates a second preferred embodiment in which a visual indicator 28 is included. Indicator 28 may comprise a light emitting diode or other visual indicator. Alternatively, visual indicator 28 may comprise a visual output such as a digital watch face indicating the elapsing of a predetermined number of seconds. Timer 20 and indicator 26 operate based on power supply 30. In a preferred embodiment, power supply 30 is a battery that provides power to timer 20 and indicator 26, or alternatively, indicator 28. Further embodiments, both audible indicator 26 and visual indicator 28 may both be included in the invention.

While the invention disclosed can be used for a plurality of exercises and stretches, the seated hamstring stretch is used by way of explanation. Note that alternative stretches may include a chest stretch, an upper back stretch, a shoulder stretch, triceps stretch, biceps stretch, lower back stretch, calf stretch, quadriceps stretch, IT band stretch, and adductor stretch, and other hamstring stretches including those where the individual lies on the ground, among others. FIG. 1 illustrates individual 50 holding stretching apparatus A in a seated hamstring stretch. His left arm is holding first elongated handle 12 and his right hand is holding second elongated handle 14. Foot grip 11 is engaged by the foot of individual 50 during use, as can best be seen in FIG. 1. Grasping the elongated handles with his hands, he has engaged the exposed portion of strap with his foot. By pulling back with his hands, strap 16 pulls timer actuator 22 into a position allowing timer 20 to operate. After a predetermined period of time, for example 10 seconds, audible indicator 26 will beep a single time. After the elapsing of a second 10 seconds, audible indicator may beep two times. Likewise, for 30, 40 and 50 seconds. At 60 seconds, or at other desired stretch times, audible indicator 26 will emit a longer, single, audible alert, indicating the completion of the stretch. Thus, an individual stretches for the proper period of time in a proper position. Note that if user 50 releases tension during the middle of the stretch, timer actuator 22 returns to a position wherein the circuit allowing operation of timer 20 is open, and thus, cannot run. Thus, the user would have to begin the stretch over from zero.

Figure 3B:
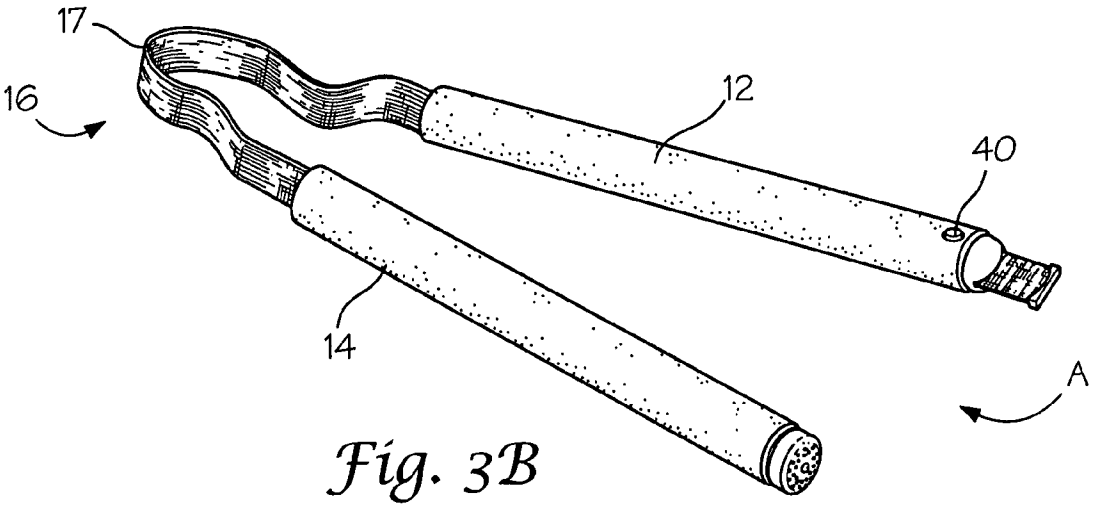
FIG. 3B is a perspective view illustrating an alternative embodiment of the invention in which the strap used can be shortened or lengthened.

An alternative embodiment is illustrated in FIG. 3B. As is shown in FIG. 3B, the strap is adjustable for people of varying heights. A button release 40 is shown in FIG. 3B. Note that any other form of tightening or loosening straps such as those found on backpacks, shoulder straps, suitcases, etc., may be used and button release 40 is shown by way of explanation only. Clips such as those used in backpacks may be carried by the handle, or alternatively, be carried by the strap for adjusting the length of the strap.

While a preferred embodiment of the invention has been described using specific terms, such description is for illustrative purposes only, and it is to be understood that changes and variations may be made without departing from the spirit or scope of the following claims.

What is claimed is:

1. An exercise apparatus for exercising and stretching comprising:

a first elongate handle extending longitudinally for being grasped by an individual's hand during use having first and second ends;

a second elongate handle extending longitudinally for being grasped by an individual's hand during use having first and second ends;

a strap carried by said first and second handles, said strap extending in the same direction of said first and second handles and past said second ends of said handles to define a body grip to be engaged by the individual during exercise;

a timer carried by said first handle for determining the time elapsed during exercise;

a timer actuator operatively associated with said strap for actuating said timer which said individual exerting sufficient pressure upon said body grip while exercising; and an indicator for indicating a predetermined period of elapsed time calculated by said timer while exercising.

2. The apparatus of claim 1 wherein said strap is received inside said handles and said body grip is defined by an exposed portion of said strap extending between said second ends of said handles.

3. The apparatus of claim 1 wherein said indicator comprises an audible indicator for audibly indicating the elapsing of a predetermined period of time.

4. The apparatus of claim 3 wherein said audible indicator includes a plurality of audible signals occurring at different intervals of elapsed time.

5. The apparatus of claim 3 wherein said audible indicator comprises a buzzer for audibly indicating the elapsing of a predetermined period of time.

6. The apparatus of claim 1 wherein said indicator comprises a visual indicator for visually indicating the elapsing at a predetermined amount of time.

7. The apparatus of claim 6 wherein said visual indicator comprises a light emitting diode for visually indicating the elapsing at a predetermined amount of time.

8. The apparatus of claim 1 further comprising a strap adjusting means carried by at least one of said first and said second elongate handles for adjusting the length of said strap.

9. The apparatus of claim 1 wherein said timer actuator comprises a pull pin for actuating said timer in response to a movement of said strap.

10. The apparatus of claim 1 further comprising a strap connector for connecting said strap to said timer actuator.

11. The apparatus of claim 1 wherein said strap connector comprises a D-ring connector operatively associated with said strap and said timer actuator for connecting said strap to said timer actuator.

12. The apparatus of claim 1 wherein said timer includes a switch pad, and said timer having a de-actuated position when said timer actuator contacts said switch pad and an actuated position when contact between said timer actuator and switch pad is broken due to exertion by the individual's foot against the foot grip.

13. The apparatus of claim 12 wherein said timer circuit produces a plurality of audible signals at predetermined intervals.

14. The apparatus of claim 13 wherein said timer circuit produces a final audible signal distinguishable from said plurality of audible signals at a predetermined time following said plurality of audible signals.

15. An exercise apparatus for providing a timed exercise duration comprising:

first and second handles for being grasped by an individual's hand during exercise;

a strap carried by said first and second handles:

a body grip included in said strap for being engaged by the individual during exercise;

a timer carried by said handle for calculating elapsed time during exercise;

a timer actuator operatively associated with said strap for actuating said timer which said individual exerts sufficient actuation pressure upon said body grip so that said timer calculates a time period while said timer is actuated; and an indicator for indicating a predetermined elapsed time period calculated by said timer during exercise.

16. The apparatus of claim 15 wherein said strap is received within said handles and said body grip is defined by an exposed portion of said strap extending from said handles.

17. The apparatus of claim 15 wherein said indicator comprises an audible indicator for audibly indicating the predetermined elapsed period of time.

18. The apparatus of claim 15 wherein said indicator is an audible indicator emitting a plurality of audible signals occurring at different intervals of elapsed time.

19. The apparatus of claim 15 wherein said indicator comprises a visual indicator for visually indicating the predetermined time lapse.

20. A method of performing a stretching exercise in a timed controlled manner using an associated apparatus comprising:

providing an apparatus having two elongate handles, a strap carried by said handles having a body grip, a timer actuator operatively associated with said strap, a timer activated by said timer actuator and an indicator associated with said timer for calculating a predetermined elapsed time;

engaging said body grip with a portion of the individual's body in a proper exercise position;

actuating said timer in response to engaging said body grip;

determining the elapsed time while the exercise position is held by the individual;

automatically emitting an indicator after said timer measures a predetermined elapsed time.

21. The method of claim 20 further comprising the step of producing a plurality of audible signals at predetermined intervals.

22. The method of claim 20 further comprising the step of producing a final audible signal distinguishable from said plurality of audible signals at a predetermined time following said plurality of audible signals.

* * * * *